US010220402B2

(12) United States Patent
Fleisch et al.

(10) Patent No.: US 10,220,402 B2
(45) Date of Patent: Mar. 5, 2019

(54) CHANGING DEVICE FOR COATING MEDIA AND COATING SYSTEM FOR COATING OBJECTS

(71) Applicant: Eisenmann SE, Boeblingen (DE)

(72) Inventors: Juergen Fleisch, Lauffen am Neckar (DE); Felix Klink, Horb (DE); Herbert Schulze, Aidlingen (DE)

(73) Assignee: EISENMANN SE, Boeblingen (DE)

( * ) Notice: Subject to any disclaimer, the term of this patent is extended or adjusted under 35 U.S.C. 154(b) by 0 days.

(21) Appl. No.: 15/500,612

(22) PCT Filed: Jul. 30, 2015

(86) PCT No.: PCT/EP2015/001566
§ 371 (c)(1),
(2) Date: Jan. 31, 2017

(87) PCT Pub. No.: WO2016/015866
PCT Pub. Date: Feb. 4, 2016

(65) Prior Publication Data

US 2017/0216868 A1 Aug. 3, 2017

(30) Foreign Application Priority Data

Jul. 31, 2014 (DE) ..... 10 2014 011 415

(51) Int. Cl.
*B05B 12/14* (2006.01)
*B05B 5/00* (2006.01)
(Continued)

(52) U.S. Cl.
CPC ..... *B05B 12/149* (2013.01); *B05B 12/1481* (2013.01); *B05B 5/1633* (2013.01); *B05B 15/55* (2018.02); *F17D 3/03* (2013.01)

(58) Field of Classification Search
None
See application file for complete search history.

(56) References Cited

U.S. PATENT DOCUMENTS 3,240,225 A * 3/1966 Barrows ..... B05B 7/24 137/240
3,674,207 A 7/1972 Carbonetti et al.
(Continued)

FOREIGN PATENT DOCUMENTS

DE 2 043 789 4/1971
DE 116 147 11/1975
(Continued)

*Primary Examiner* — Binu Thomas
(74) *Attorney, Agent, or Firm* — Schroeder Intellectual Property Law Group, LLC

(57) ABSTRACT

A changing device for coating media having a plurality of supply units. The device includes an electric valve device with each supply unit having an electric valve unit which opens and closes a flow channel through which a medium may be supplied in response to a control signal. The valve device includes a control system which has a switching device for each supply unit, each switching device selectively allowing or blocking a control signal from reaching a respective valve unit. The valve device also includes a triggering device which is carried by at least one coupling unit which couples the plurality of supply units to an application device. The triggering device triggers the switching device to allow the control signal through to a supply unit when the coupling unit is connected to the supply unit in a fluid-tight manner.

4 Claims, 9 Drawing Sheets

(51) Int. Cl.

| | |
|---|---|
| ***F17D 3/03*** | (2006.01) |
| *B05B 5/16* | (2006.01) |
| *B05B 15/55* | (2018.01) |

(56) References Cited

U.S. PATENT DOCUMENTS

| | | | | |
|---|---|---|---|---|
| 3,716,191 | A | 2/1973 | Knight | |
| 4,034,584 | A | 7/1977 | Klein et al. | |
| 4,084,615 | A | 4/1978 | Klein et al. | |
| 4,215,350 | A | 7/1980 | Mielke et al. | |
| 8,567,341 | B1 | 10/2013 | Thies | |
| 2003/0015607 | A1* | 1/2003 | Ehinger | B05B 12/149 239/526 |
| 2003/0118392 | A1* | 6/2003 | Vetters | B05B 12/14 401/118 |
| 2013/0255810 | A1 | 10/2013 | Krogedal et al. | |
| 2016/0052004 | A1* | 2/2016 | Krogedal | B05B 7/26 137/237 |

FOREIGN PATENT DOCUMENTS

| | | | | |
|---|---|---|---|---|
| DE | 29 15 646 | A1 | 10/1979 | |
| DE | 199 62 220 | A1 | 7/2001 | |
| DE | 19962220 | A1 * | 7/2001 | B05B 12/14 |
| EP | 0 979 964 | A2 | 2/2000 | |
| EP | 2 644 281 | A1 | 10/2013 | |
| GB | 1 232 893 | | 5/1971 | |
| GB | 1 456 458 | | 11/1976 | |
| WO | 89/10796 | A1 | 11/1989 | |
| WO | 01/51216 | A2 | 7/2001 | |
| WO | 2009/123794 | A1 | 10/2009 | |

* cited by examiner

CHANGING DEVICE FOR COATING MEDIA AND COATING SYSTEM FOR COATING OBJECTS

RELATED APPLICATIONS

This application is a national phase of International Patent Application No. PCT/EP2015/001566, filed Jul. 30, 2015, which claims the filing benefit of German Patent Application No. 10 2014 011 415.5, filed Jul. 31, 2014, the contents of both of which are incorporated herein by reference.

FIELD OF THE INVENTION

The invention relates to a changeover apparatus for coating media, in particular for paints, having a) a plurality of supply units, each of which has at least one inlet connection, which can be connected to a reservoir for a medium, and an outlet connection, a flow channel extending between said connections;

b) at least one coupling unit, which has an entry connection and an exit connection, which can be connected to an application device, a through-channel extending between said connections;

c) a positioning device, by means of which the coupling unit can be moved relative to the supply units, wherein d) the entry connection of the coupling unit can be coupled in a fluid-tight manner to the outlet connection of a supply unit and can be separated therefrom again;

e) a valve device is present, in the case of which each supply unit comprises a valve unit which, in a release configuration, releases the flow channel and, in a closed configuration, closes said channel and which can be moved into the release configuration by means of a control signal.

The invention also relates to a coating system for coating objects, having a) an application device;

b) a plurality of reservoirs for in each case one coating medium;

c) at least one changeover apparatus having a plurality of inlet connections, each of which is connected to a dedicated reservoir for coating medium, and having at least one exit connection, which is connected to the application device, and by means of which a coating medium can optionally be directed from a reservoir to the application device.

BACKGROUND OF THE INVENTION

Such changeover devices and coating systems are used, for example, in the automotive industry for painting vehicle bodies and the add-on parts thereof.

For example, in the case of a painting facility, use is made of a changeover device for coating media, i.e. then a color-changeover device, if it is relatively frequently the case during normal operation that, for the purpose of coating an object, use should be made of a paint other than that paint with which a previous object was painted.

It has to be reliably ensured here that a certain flow channel is released only when the coupling unit is also actually coupled to the supply unit which belongs to the flow channel in question.

SUMMARY OF THE INVENTION

An object of the invention is to create a changeover apparatus and a coating system of the type mentioned in the introduction which ensure that this takes place.

This object may be achieved in the case of a changeover apparatus of the type mentioned in the introduction in that f) the valve device comprises a control system which fa) has a switching device for each supply unit, said switching device, in a switching configuration, allowing the control signal through to the valve unit and, in a blocking configuration, blocking the control signal to the valve unit;

fb) has a triggering device, which is carried along by the coupling unit and which triggers at least one switching operation of the switching device from the blocking configuration into the switching configuration when the entry connection of the coupling unit is, or has been, coupled in a fluid-tight manner to the outlet connection of a supply unit.

According to the invention, the control signal may already be present at the switching device even when the coupling unit is separated from the associated supply unit. It is only when the coupling unit is moved up to a certain supply unit that the switching device is triggered during the coupling operation, or preferably following completion thereof, as a result of which the valve unit receives the control signal necessary for achieving its release configuration. As will also be explained in more detail hereinbelow, a control signal can be formed by the presence or by the absence of a control parameter. Without the specific presence of the coupling unit, however, the valve unit which is to be opened does not receive any control signal, and this significantly increases the operational reliability.

It is particularly advantageous if the valve device is an electric valve device and a valve unit of a supply unit is an electric valve which is arranged in a circuit which can be closed or interrupted by the switching device.

In the case of a first alternative, the electric valve can assume its release configuration when the circuit is closed and can assume its blocking configuration when the circuit is interrupted.

In the case of a second alternative, the electric valve can assume its blocking configuration when the circuit is closed and can assume its release configuration when the circuit is interrupted. This corresponds to the abovementioned concept where the absence of a parameter forms a control signal.

Preferably, a) the switching device is an electric bridge device with two contact locations which are accessible from the outside;

b) the triggering device is a bridging device by means of which the contact locations of the bridging device can be connected to one another.

A technical alternative consists in that a) the switching device is a spring-loaded switch with two contact locations and a spring-loaded, electrically conductive connecting piece, which can be moved between a position in which it connects the contact locations in a conductive manner and a position in which the circuit is interrupted;

b) the triggering device is a pressure-exerting device by means of which the connecting piece can be pushed from one position into the other position.

As an alternative, it is possible a) for the switching device to be a magnetic switch by means of which, in one configuration, the circuit can be closed or, in one configuration, the circuit can be interrupted;

b) for the triggering device to be a magnetic actuator (58.3) by means of which the magnetic switch can be switched from one configuration into the other configuration.

As an alternative to the electric valve device, it is possible for the valve device to be a pneumatic valve device and for a valve unit of a supply unit to be a pneumatic valve which is connected to a fluid line which is supplied from a compressed-gas source.

It is advantageous here if the pneumatic valve assumes its release configuration when it is subjected to the action of compressed gas, and in that it assumes its closed configuration when there is no compressed gas present.

As a further alternative, it may be advantageous if the pneumatic valve assumes its closed configuration when it is subjected to the action of compressed gas, and in that it assumes its release configuration when there is no compressed gas present. This once again realizes the concept where the absence of a control parameter, in this case therefore the absence of pressure loading, serves as a control signal.

It is advantageous then if a) the switching device is a fluid-pressure switch, for which purpose the fluid line forks into an outlet line, which leads to an outlet opening, and a pressure line, which leads to the valve;

b) the triggering device is a closure device with a plug element, by means of which the outlet opening can be closed.

As an alternative, it is possible a) for the switching device to be a fluid-pressure switch, for which purpose the fluid line forks into an outlet line, which leads to an outlet opening, and a pressure line, which leads to the valve, wherein the outlet opening can be closed by a nonreturn valve with a movable closing body which, in a basic configuration, closes the outlet opening and, in an operating configuration, releases the outlet opening;

b) for the triggering device to be a pressure-exerting device with a pressure-exerting element by means of which the closing body can be moved out of the basic configuration into the operating configuration.

The object mentioned above may be achieved in the case of the coating system of the type mentioned in the introduction in that d) the changeover apparatus is a changeover apparatus having some or all of the features explained above.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail hereinbelow with reference to the drawings, in which.

DETAILED DESCRIPTION OF THE PRESENT INVENTION

Figure 1:
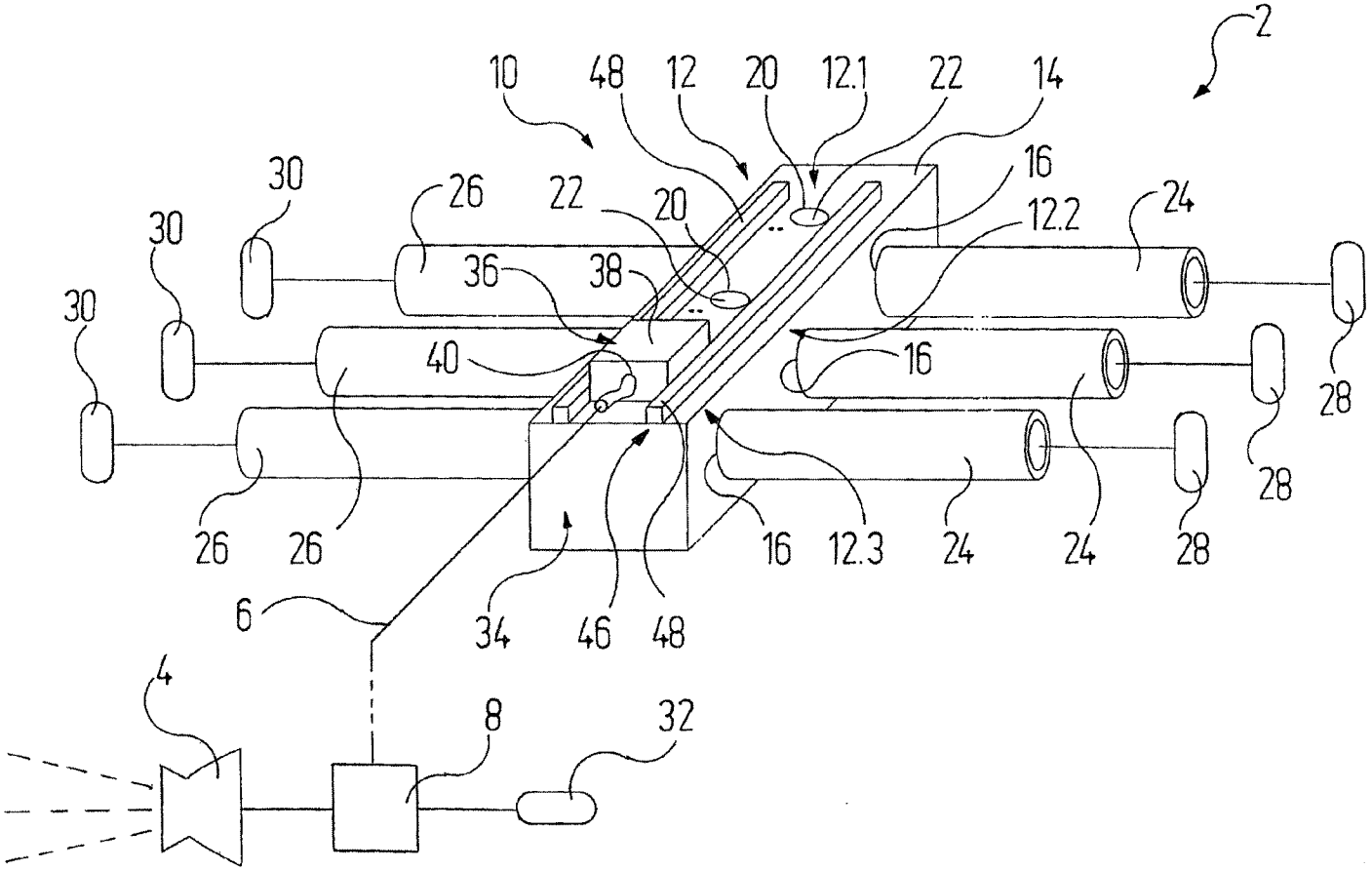
FIG. 1 shows a schematic layout view of a coating system with a linear changeover apparatus having a plurality of supply units and a movable coupling unit.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference will be made first of all to FIG. 1. There, 2 is comprehensively used to denote a coating system for applying coating media, the coating system comprising an application device 4. In the present case, a description is given, by way of example, of a coating system 2 for paints. In this case, the application device 4 may be, for example, a spray gun or a high-speed rotary atomizer and may also operate electrostatically, as is known per se.

If the text hereinbelow refers to a connection between connections, channels or lines, it means predominantly in each case a fluidic connection between such components, corresponding flow paths being formed as a result. Terms used hereinbelow such as inlet, outlet, entry or exit, or corresponding connections, refer merely to a flow of medium in the direction of the application device. As is made clear hereinbelow, however, it is also possible for medium to flow in the other direction and, in the process, to flow out through an inlet or entry or to flow in through an outlet or exit.

The application device 4 is fed via a line 6. The coating system 2 is operated, in a manner known per se, using pigging technology, for which reason the line 6 contains a pigging station 8, which is assigned to the application device 4.

At the end which is remote from the application device 4, the line 6 is connected to a changeover apparatus 10 for coating media, said changeover apparatus, in the case of coating with paint, therefore being a color-changeover device.

The changeover device 101 comprises a plurality of supply units 12, wherein FIGS. 1 and 2 show merely three supply units 12.1, 12.2 and 12.3. The changeover device 10 comprises at least two, and they may also comprise more than three, such supply units 12. Depending on the particular application, the changeover device 10 may have, for example, 20 or even 40 such supply units 12. The supply units 12 are identical; in FIG. 1, it is only the supply unit 12.2 which is in the center there that is provided with further reference signs.

In the case of the present exemplary embodiment, the supply units 12 are accommodated in a common housing 14, which is designed, for example, in the form of a housing block. It is also possible, however, for the supply units 12 each to be designed in the form of a separate structure unit and each to have a dedicated housing or a dedicated housing block.

Each supply unit 12 has an inlet connection 16 for coating medium, a rinsing-agent connection 18 for rinsing agent, said connection not being evident in FIG. 1, and an outlet connection 20. The inlet connection 16 and the rinsing-agent connection 18 open out into a flow channel 22, which leads to the outlet connection 20 and of which FIG. 1 shows a short end portion only for the supply units 12.1 and 12.2.

The inlet connection 16 and the rinsing-agent connection 18 of a supply unit 12 can be closed or opened separately in each case by a corresponding, but not specifically shown paint-color valve and rinsing valve, respectively. For example needle valves which are known per se may be provided for this purpose, each interacting with corresponding valve seats of the inlet connection 16 and of the rinsing-agent connection 18.

The inlet connections 16 and the rinsing-agent connections 18 of the individual supply units 12 are each connected to a dedicated paint-color reservoir 28 and a collecting container 30, respectively, via a paint-color line 24 and a rinsing line 26, respectively. Different paints, that is to say, in general terms, different coating materials, are provided in the respective paint-color reservoirs 28 assigned to a certain supply unit 12. Instead of being connected in each case to a separate collecting container 30, it is also possible for a plurality of supply units 12 to be connected to one and the same collecting container 30. A further rinsing-agent reservoir 32 is connected to the pigging station 8 at the application device 4.

Reservoir is understood here to mean any technical solution for supplying or accommodating different media. This therefore also includes, for example, ring-line systems, as are known per se.

The individual supply units 12 form, in a linear arrangement, a supply module 34, via which the application device 4 can be supplied with a corresponding number of different colors.

In order to direct a color from one of the supply units 12 to the application device 4, a coupling unit 36 is connected to that end of the line 6 which is remote from the pigging station 8, it being possible for the supply units 12 to be coupled to the application device 4 by said coupling unit.

The coupling unit 36 comprises a pigging station 38 (not shown any more specifically) and an exit connection 40, which is connected to the line 6. The coupling unit 36 also comprises an entry connection 42, which is designed to complement the outlet connections 20 of the supply units 12 and is connected fluidically via a channel 44 which can be seen in FIGS. 2 to 5, by way of the pig housing 38, to the exit connection 40 and, in this way, to the line 6.

The supply units 12 and the coupling unit 36 can be moved relative to one another for a color changeover, it therefore being possible for the entry connection 40 of the coupling unit 36 to be coupled in a fluid-tight manner to the outlet connection 20 of a supply unit 12 and to be separated therefrom again.

For this purpose, the changeover device 10 comprises a positioning device 46, which is shown only in FIG. 1 and with the aid of which, in the case of the present exemplary embodiment, the coupling unit 36 can be moved along the supply module 34 and positioned in relation to a predetermined supply unit 12. For this purpose, in the case of the present exemplary embodiment, the coupling unit 36 is mounted in a displaceable manner in a guide rail 48, extending parallel to the supply module 34, and can be displaced therein with the aid of drive means which are known per se, but are not shown specifically.

The changeover apparatus 10 has a valve device 50, in the case of which each supply unit 12 comprises a valve unit 52. It is possible for each valve unit 52, in a release configuration, to release the flow path 22 via the outlet connection 20 and, in a closed configuration, to close said flow path and to be moved into the release configuration by means of a control signal when the entry connection 40 of the coupling unit 36 is coupled in a fluid-tight manner to the outlet connection 20 of a supply unit 12.

For this purpose, the valve device 50 comprises a control system which, for each supply unit 12, has a switching device 56 which, in a switching configuration, allows the control signal through to the valve unit 52 and, in a blocking configuration, blocks the control signal to the valve unit 52.

The control system 54 of the valve device 50 also comprises a triggering device 58, which is carried along by the coupling unit 36 and which triggers at least one switching operation of the switching device 56 from the blocking configuration into the switching configuration when the entry connection 40 of the coupling unit 36 has been coupled in a fluid-tight manner to the outlet connection 20 of a supply unit 12.

Reference will now be made to FIGS. 2 to 5. For the sake of clarity, the rinsing-agent connections 18, the rinsing lines 24, the paint-color reservoirs 28 and the collecting containers 30 are not shown in said figures. Moreover, it is only the essential component parts and, in the case of the supply units 12, largely only the rest of the components of the supply unit 12.1 which are provided with reference signs in each case.

Figure 2A:
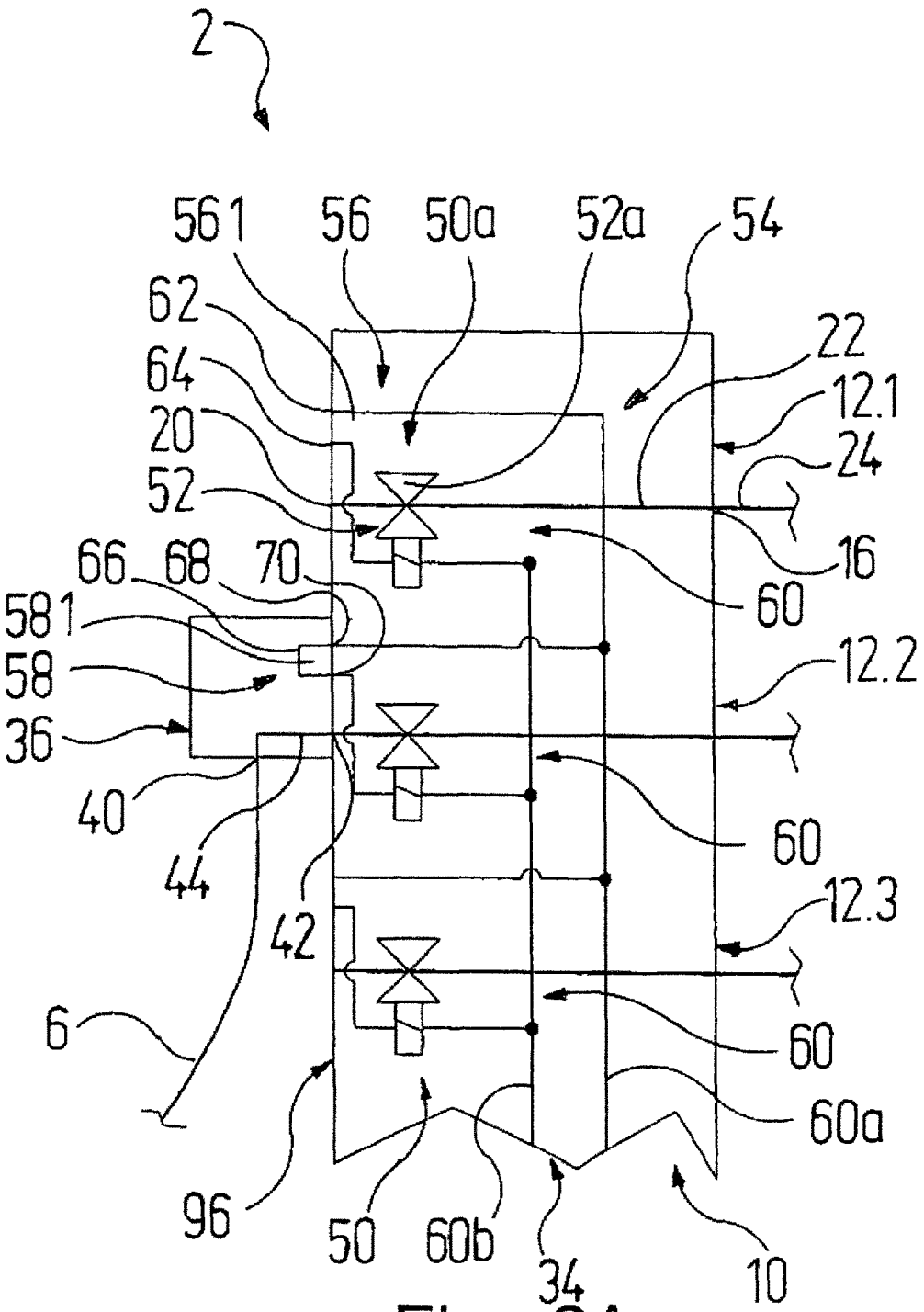
FIG. 2A shows a schematic layout view of a first exemplary embodiment of the changeover apparatus having a valve device and a control system, in an application configuration.
Figure 2B:
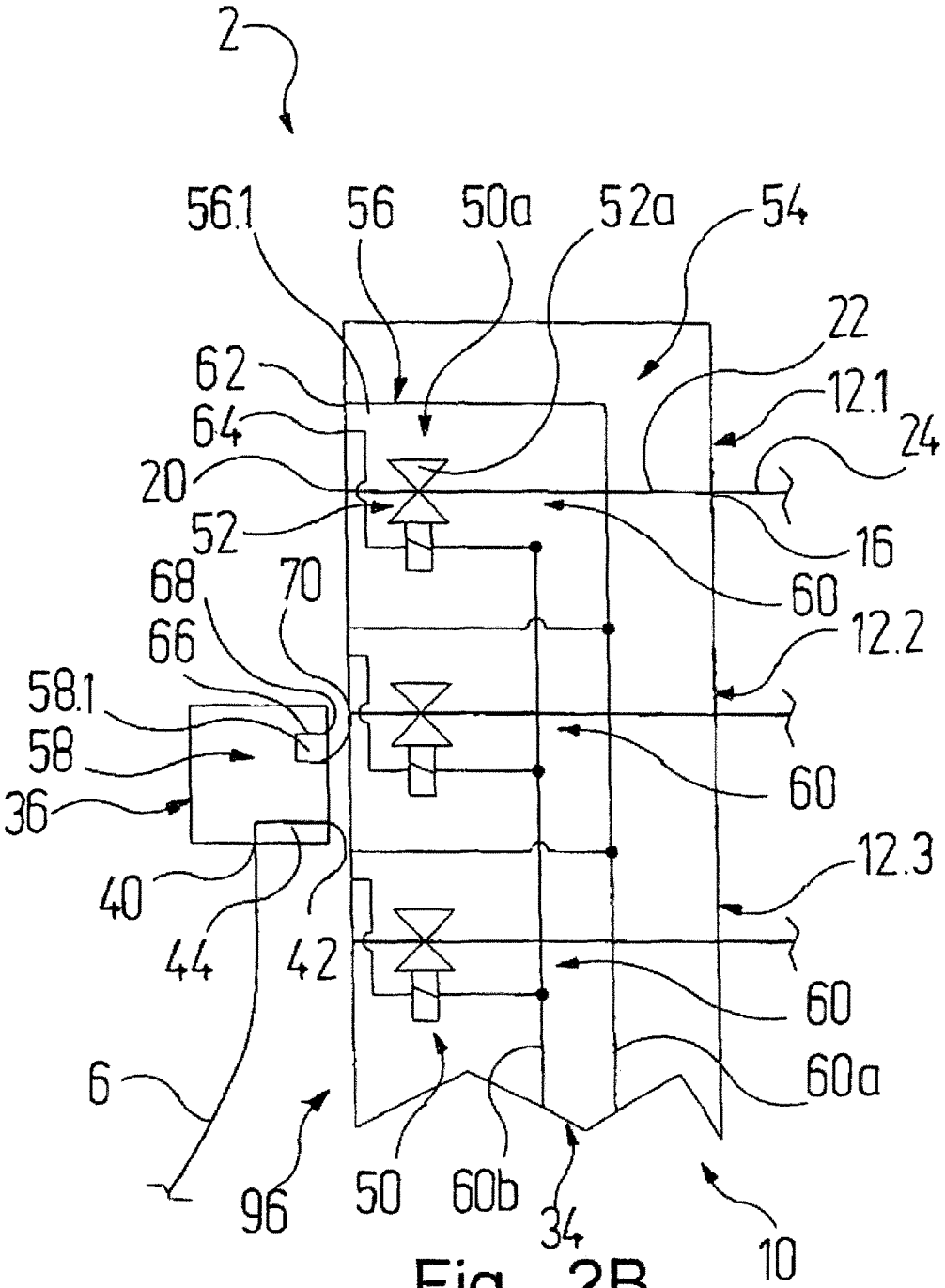
FIG. 2B shows the changeover apparatus according to FIG. 3A in a changeover configuration.

FIGS. 2A and 2B show, as a first exemplary embodiment, an electrically operating valve device 50*a* with valve units 52 in the form of electrically actuable valves 52*a*, as are known per se. The control signal for the valves 52*a* is thus an electric signal.

The valves 52*a* are each arranged in a circuit 60. In the case of the exemplary embodiment shown, all the circuits 60 present are formed from a conductor 60*a* in conjunction with a neutral conductor or protective conductor 60*b*, which for their part come from a common power source, which for the sake of simplicity is not shown specifically. In the case of a modification, it is also possible for each circuit 60 to have a dedicated power source. The switching devices 56 are set up such that they can close or interrupt the respective circuit 60.

The switching device 56 is designed here in any case in the form of an electric bridge device 56.1 with two contact locations 62 and 64, which are accessible from the outside on the side of the outlet connection 20 on the housing 14 of the supply module 34. In the switching configuration of the bridge device 56.1, the two contact locations 62, 64 are connected to one another in a conductive manner, and therefore the circuit 60 is closed and the associated valve 52*a* is open. In the blocking configuration of the bridge device 56.1, the two contact locations 62, 64 are not connected to one another and the circuit 60 is interrupted, wherein the associated valve 52*a* then assumes its closed position. This can be achieved, for example, by the valve 52*a* being subjected to spring prestressing, as is known per se.

The triggering device 58 is designed in the form of a bridging device 58.1 by means of which the contact locations 62, 64 can be connected to one another. In the case of the present exemplary embodiment, the bridging device 58.1 comprises has two connection contacts 68, 70, which are connected to one another in a conductive manner via an electric conductor 66. Said connection contacts complement the contact locations 62 and 64 and are fitted on the outer side of the coupling element 36, said outer side being oriented toward the supply module 34, such that the circuit is closed by means of the bridging device 58.1 when the entry connection 40 of the coupling unit 36 has been coupled in a fluid-tight manner to the outlet connection 20 of the supply unit 12.

When the circuit is closed, the control signal consequently passes to the valve 52*a*, which then opens and releases the flow channel 22. This is depicted in FIG. 2A, which shows the changeover apparatus 10 in an application configuration, in the case of which paint is delivered from the paint-color reservoir 28 of the supply unit 12.2 to the application device 4 and can be applied to an object. The operation of the coating system 2 per se, i.e. the rinsing operations during a color changeover, the activation of other valves present, but not shown specifically, in the supply module 34 and the use of pigs between the pigging station 8 at the application device 4 and the pigging station 38 of the coupling unit 36 correspond to the prior art.

The bridging device 58.1 can basically operate in two ways. On the one hand, it can direct a signal directly to the valve 52*a*; in this case, the bridging device 58.1 closes a load circuit. On the other hand, the bridging device 58.1 can activate a further component part which is not shown specifically here and, for its part, switches the valve 52*a*; in this case, the bridging device 58.1 closes a control circuit in relation to said further component part.

For advancing media or the pig in the line system formed by the channels and lines explained above, use can be made of media pressure provided by paint, rinsing agent, air, $CO_2$, nitrogen and the like, which are supplied in a manner known per se. For the sake of clarity, components which are necessary for this purpose, such as media sources, lines, valves and connections, are not shown specifically in the figures.

Following completion of the application of paint from the paint-color reservoir 28 of the supply unit 12.2, it is possible, if appropriate, for color changeover to take place to a second paint of a different color, for example to a paint from the paint-color reservoir 28 of the supply unit 12.3.

FIG. 2B shows the changeover apparatus 10 in a changeover configuration, in the case of which the coupling unit 36 is moved, for this purpose, from the supply unit 12.2 to the supply unit 12.3, to which end the coupling unit 36 has been uncoupled beforehand from the supply unit 12.2. During the operation of uncoupling the coupling unit 36 from the supply unit 12.1, the bridging device 58.1 has also been disengaged from the contact locations 62, 64 of the supply unit 12.1, and therefore the valve 52*a* resumes its closed position and the flow channel 22 is in a closed state.

Figure 3A:
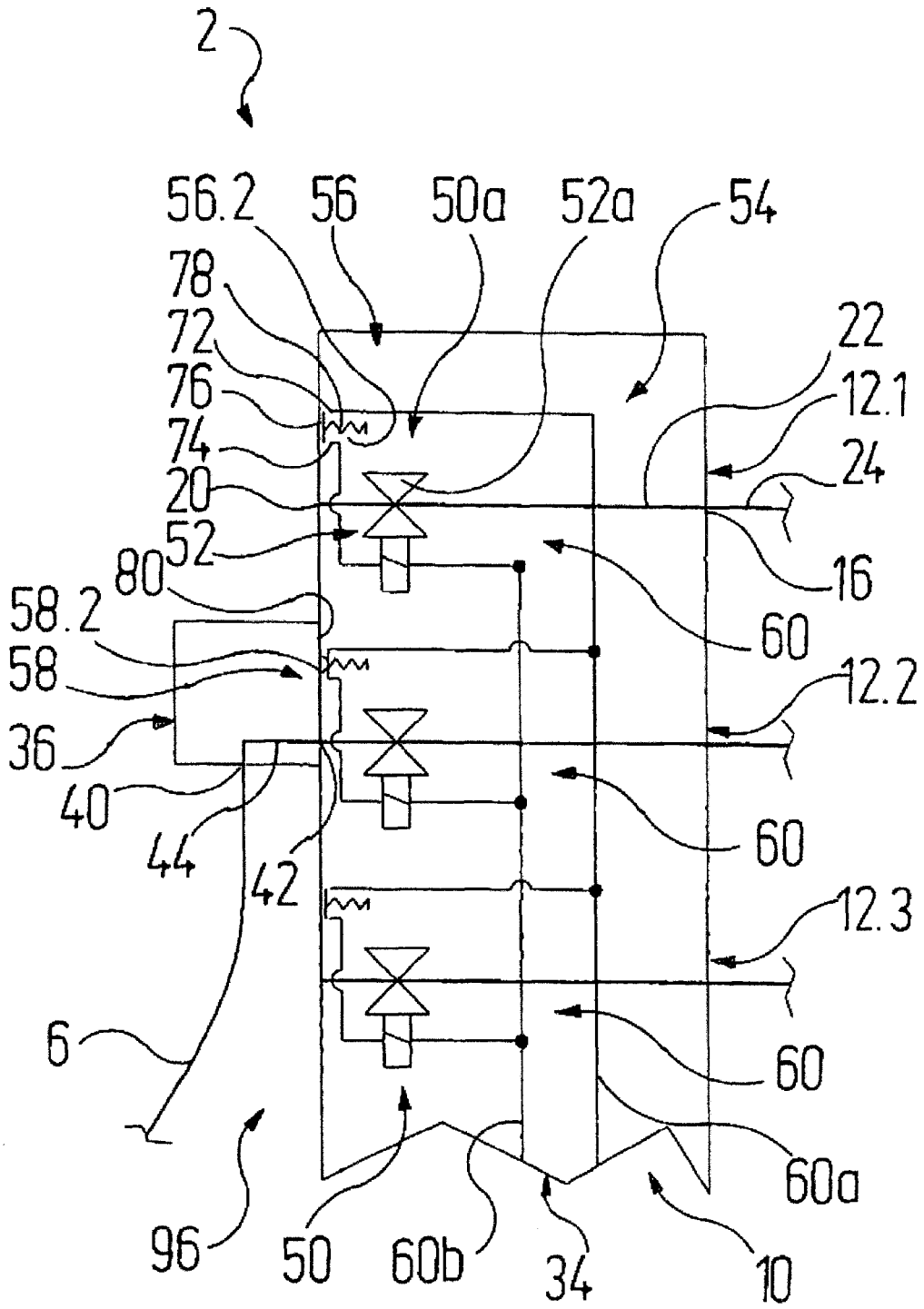
FIGS. 3A and 3B show schematically layout views, corresponding to FIGS. 2A and 2B, of a second exemplary embodiment of the changeover apparatus having a valve device and a control system.
Figure 3B:
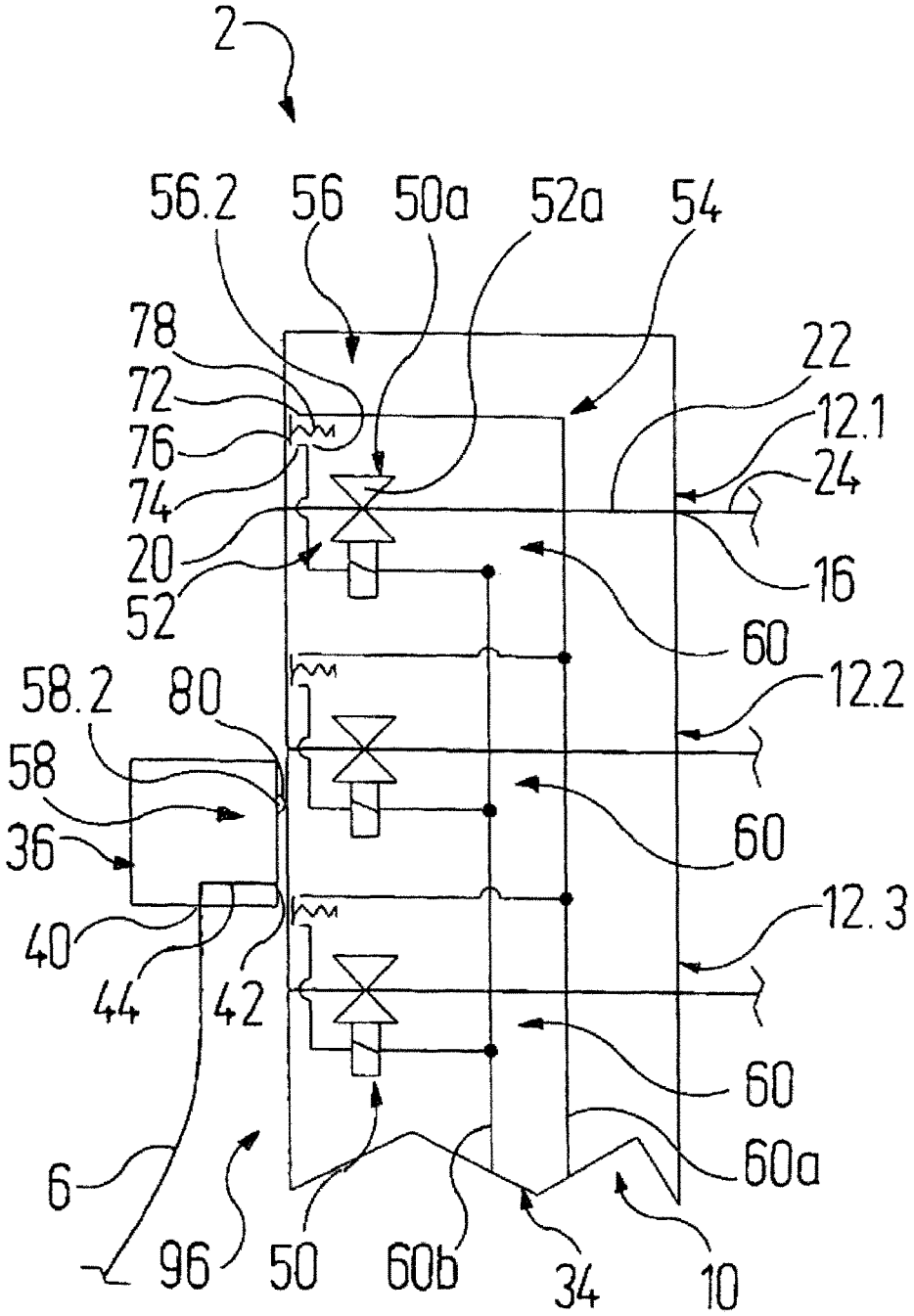

FIGS. 3A and 3B show, as a second exemplary embodiment, a modified electrically operating valve device 50*a*, which once again has valve units 52 in the form of electrically actuable valves 52*a*. Here too, therefore, the control signal is an electric signal.

The control system 54 here comprises switching devices 56 in the form of spring-loaded switches 56.2 with two inner contact locations 72, 74 of the circuit 60 and a movable, electrically conductive connection piece 76. The connecting piece 76 can be moved between a connecting position, in which it connects the contact locations 72, 74 in a conductive manner in a switching configuration, and a separating position, in which the circuit is interrupted. The connecting piece 76 is retained in the separating position under prestressing action by a spring 78.

The triggering device 58 is designed in the form of a pressure-exerting device 58.2 which, in the case of the present exemplary embodiment, has a pressure-exerting element 80 which is arranged on the coupling unit 36, and dimensioned, such that it pushes the connecting piece 76 of the spring-loaded switch 56.2 into the connecting position when the coupling element 36, couples, or has been coupled, to a supply unit 12. The associated circuit 60 is then in a closed state, the valve 52*a* assumes its release configuration and the flow path through the flow channel 22 is open. FIG. 3A shows this application configuration for the supply unit 12.2.

When the coupling unit 36 has been disengaged from the supply unit 12.2 again for a color changeover, the spring-loaded switch 56.2 resumes its blocking configuration and the valve 52*a* closes, as is depicted in FIG. 3A.

Figure 4A:
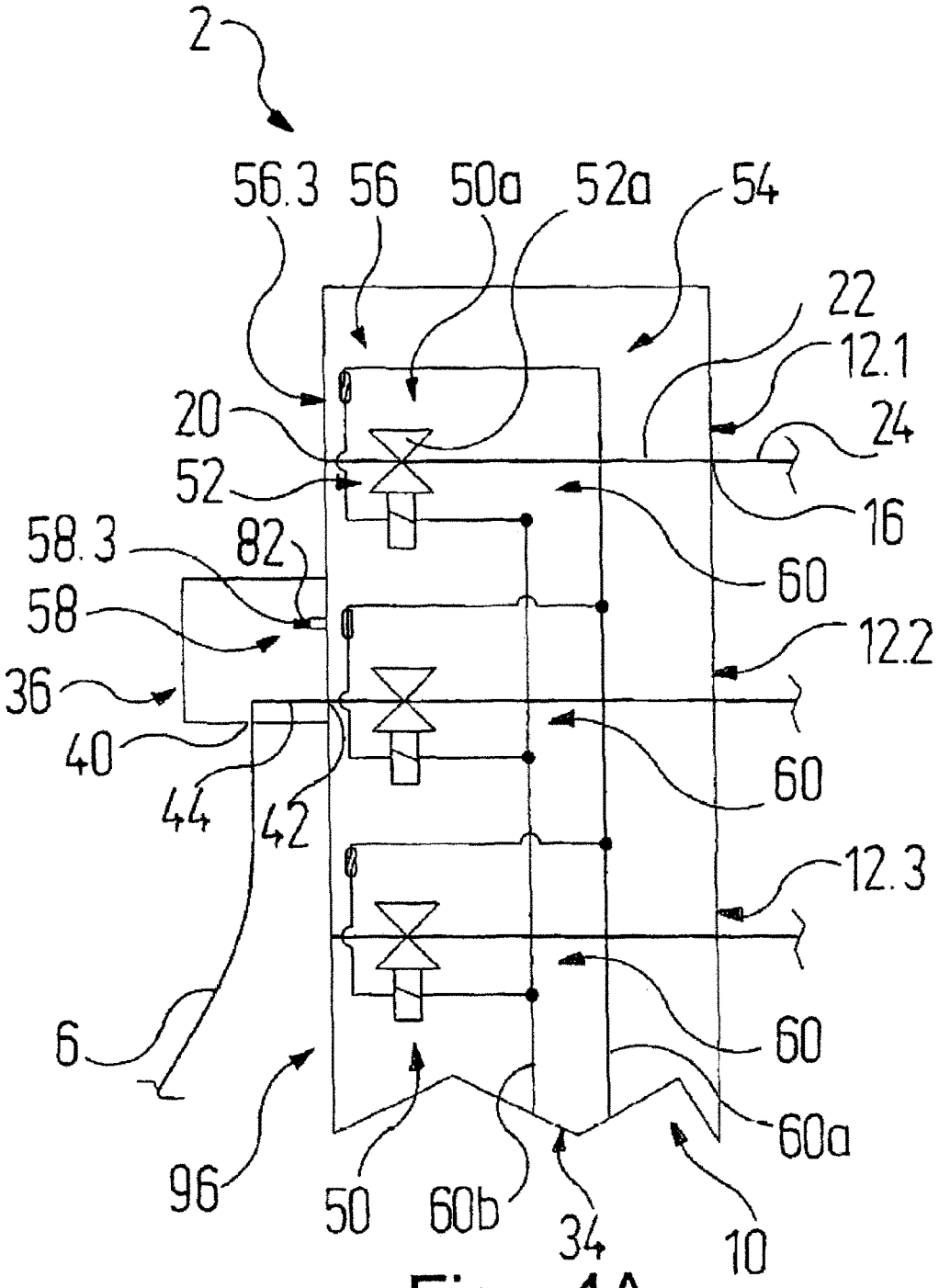
FIGS. 4A and 4B show schematic layout views, corresponding to FIGS. 2A and 2B and also 3A and 3B, of a third exemplary embodiment of the changeover apparatus having a valve device and a control system.
Figure 4B:
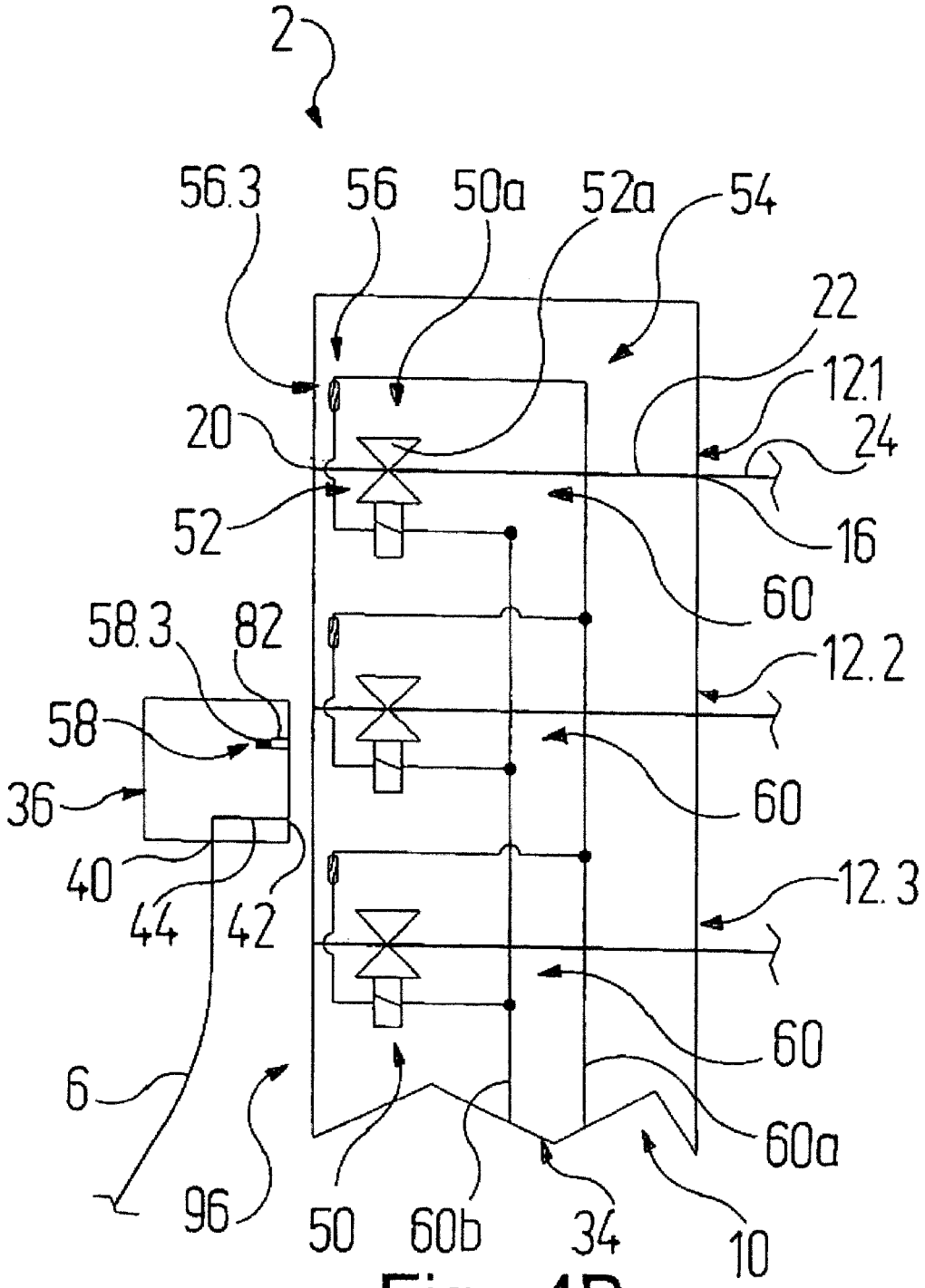

FIGS. 4A and 4B show, as a third exemplary embodiment, a further-modified electrically operating valve device 50*a*, which once again has valve units 52 in the form of electrically actuable valves 52*a*. Here too, therefore, the control signal is an electric signal.

Here, the control system 54 comprises switching devices 56 in the form of magnetic switches 56.3 which, in their switching configuration, close the respective circuit 60 and, in their blocking configuration, interrupt said circuit.

The triggering device 58 is designed in the form of a magnetic actuator 58.3 which, in the case of the present exemplary embodiment, has a permanent magnet 82 which is arranged on the coupling unit 36, and oriented and dimensioned, such that it activates the magnetic switch 56.3 when the coupling element 36 couples, or has been coupled, to a supply unit 12, as a result of which the magnetic switch 56.3 assumes its switching position. The associated circuit 60 is then in the closed state, and the valve 52*a* assumes its release configuration and opens the flow path through the flow channel 22; FIG. 4A shows this application configuration for the supply unit 12.2.

When the coupling unit 36 has been detached from the supply unit 12.2 again for a color changeover, the magnetic switch 56.3 resumes its blocking configuration and the valve 52*a* closes; this is shown in FIG. 4A.

As an alternative to the permanent magnet 82, it is also possible for an electromagnet to be provided.

In the case of all exemplary embodiments explained above in relation to the electric valve device 50*a*, the conditions are such that the electric valves 52*a* assume their release configuration when the circuit 60 is closed, wherein the triggering device 58 ensures in each case that the circuit 60 is closed.

However, it is likewise possible to realize the situation where the electric valves 52*a* assume their release configuration when the circuit 60 is interrupted and the triggering device 58 ensures in each case that the circuit 60 is interrupted. In this case, the control signal is predetermined by the absence of a control parameter, i.e. by the absence of a control current, at the respective valve 52*a*. When the coupling unit 36 is detached, the circuit 60 is then in the closed state.

In the case of the spring-loaded switch 56.2 according to FIGS. 2A and 2B, this can be achieved in that the connecting piece 76 connects the contact locations 72, 74 under the action of prestressing by the spring 78 and is separated from the contact locations 72, 74, counter to the spring force, by the pressure-exerting element 80 on the coupling unit 36. The circuit 60 is then interrupted. When the coupling unit 36 is separated from the selected supply unit, the spring 78 pushes the connecting piece 76 is into contact with the contact locations 72, 74, as a result of which the circuit 60 is in a closed state again.

In the case of the magnetic switch 56.3 according to FIGS. 3A and 3B, the magnetic switch 56.3 has to be configured in correspondingly reverse order, in which case it closes the circuit 60 when the magnetic actuator 58.3 is absent and interrupts said circuit when the magnetic actuator 58.3 is present.

Figure 5A:
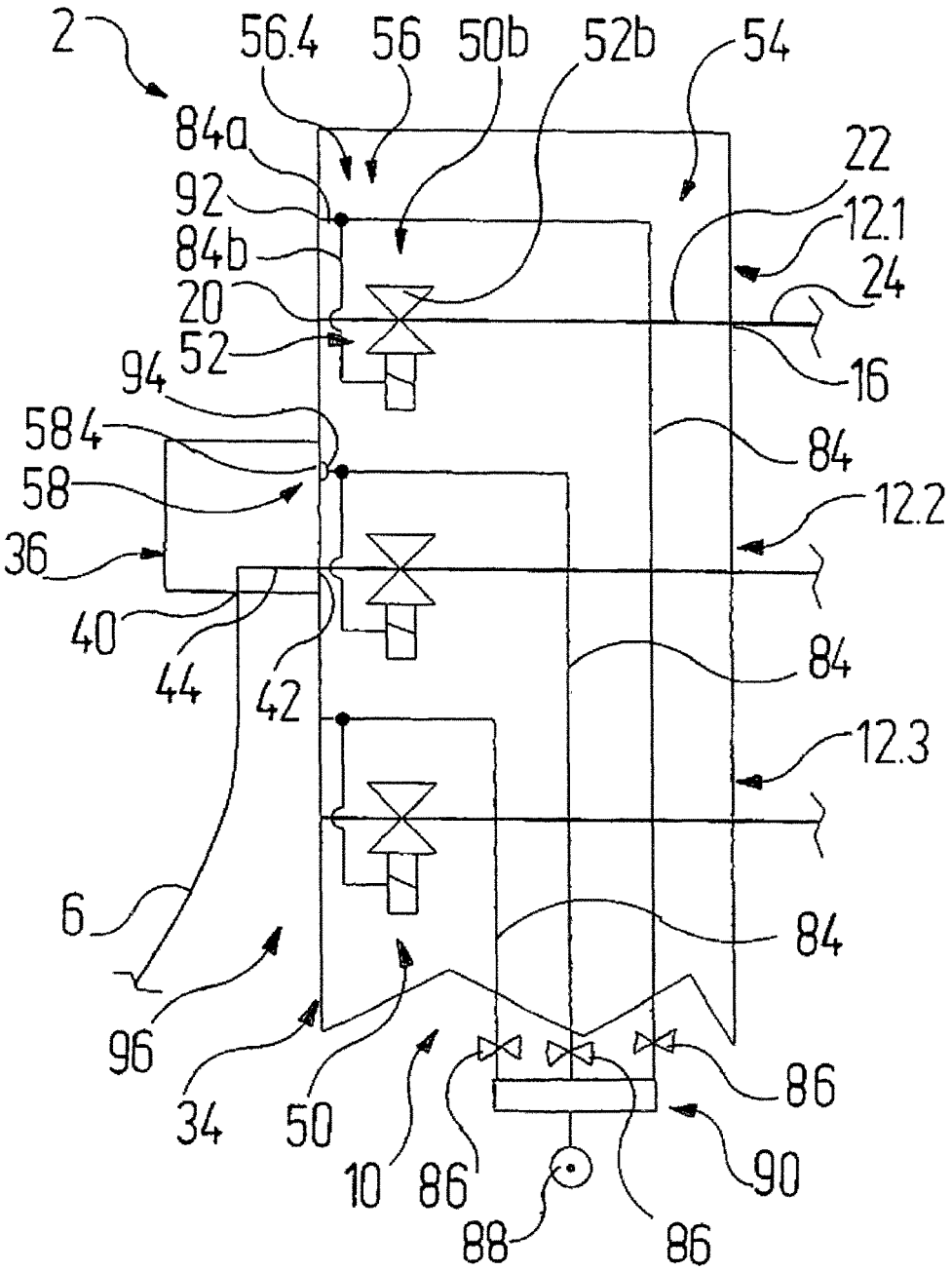
FIGS. 5A and 5B show schematic layout views, corresponding to FIGS. 2A and 2B, 3A and 3B and also 4A and 4B, of a fourth exemplary embodiment of the changeover apparatus having a control system.
Figure 5B:
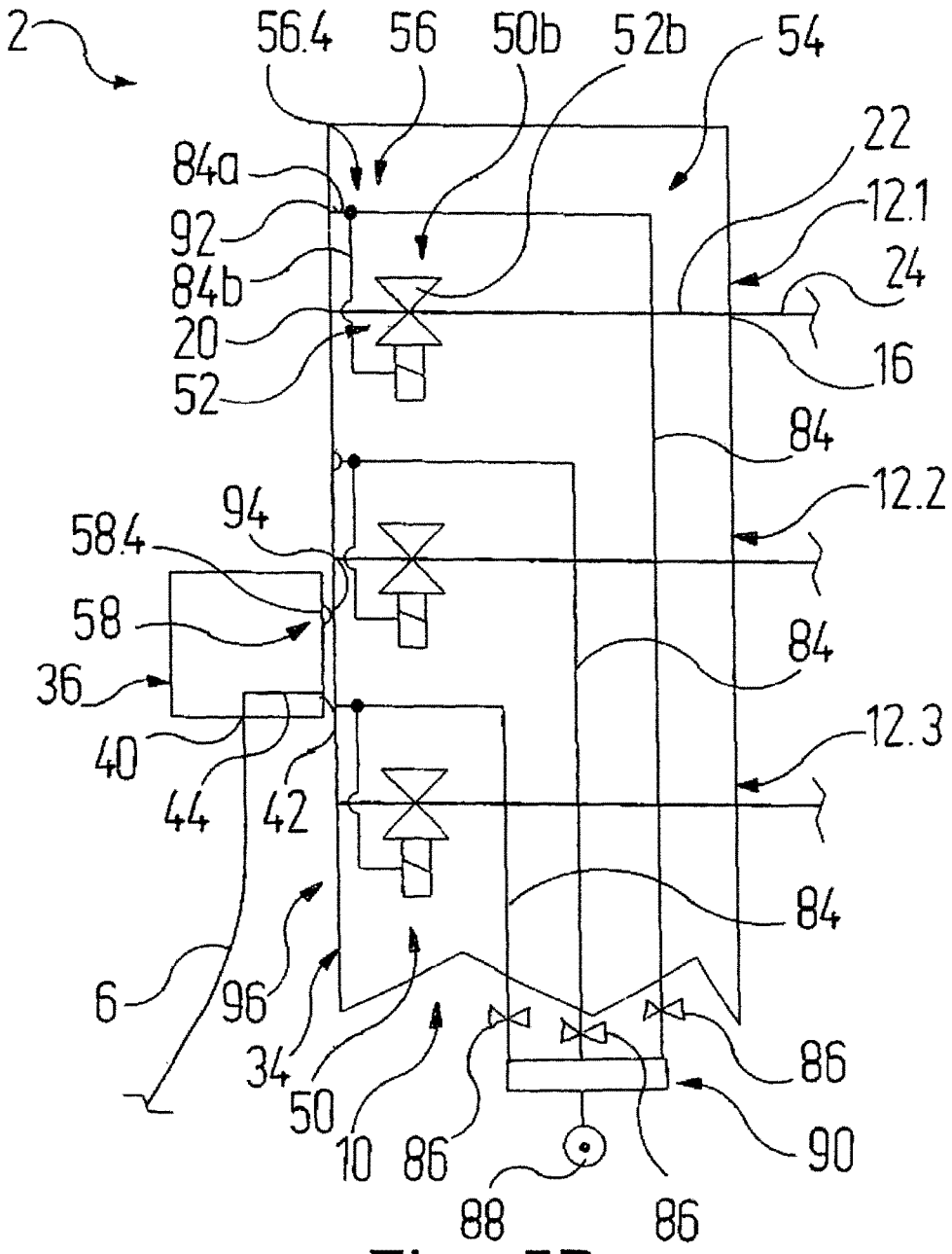

FIGS. 5A and 5B, then, show, as a fourth exemplary embodiment, a pneumatically operating valve device 50*b*, the valve units 52 of which are designed in the form of pneumatically actuable valves 52*b*, as are known per se. The control signal here is therefore a pneumatic signal. In practice, such valves 52*b* are actuated by compressed air, and this will also be assumed hereinbelow. It is also possible, however, to use gases other than compressed air for the pressure medium.

The valves 52*b* are designed such that they assume their release configuration when they are subjected to the action of compressed air, and that they assume their closed configuration when there is no compressed air present.

The control system 54, then, comprises switching devices 56 in the form of fluid-pressure switches 56.4. For this purpose, each valve 52*b* present is connected to a dedicated fluid line 84, which is supplied from a compressed-gas source 88, in this case a compressed-air source, via a control valve 86. In the case of the present exemplary embodiment, a single compressed-air source 88 is connected to the individual control valves 86 of the individual fluid lines 84 via a distributor 90.

In the case of a modification, it is also possible for a dedicated compressed-air source to be provided for each fluid line 84 present, or it is possible in each case for a plurality of distributors 90 for in each case a plurality of fluid lines 84 to be fed from one compressed-air source.

The fluid lines 84 lead to a fork 92, from where an outlet line 84*a* of the fluid line 84 runs, in the form of a first sub-line, to an outlet opening 92 on the side of the outlet connection 20 on the housing 14 of the supply module 34. A pressure line 84*b* of the fluid line 84 extends, in the form of a second sub-line, from the fork 92 to the valve 52*b*.

The triggering device 58 is designed in the form of a closure device 58.4 which, in the case of the present exemplary embodiment, comprises a plug element 94, which is designed to complement the outlet opening 92 and is arranged on the coupling unit 36 such that it closes the outlet opening 92 in a flow-tight manner when the coupling element 36 couples, or has been coupled, to a supply unit 12.

When the associated control valve 86 is open, the valve 52*b* is subjected to full pressure, said valve consequently assuming its release configuration and releasing the flow path through the flow channel 22; FIG. 5A shows this application configuration for the supply unit 12.2.

The control valve 86 on the distributor 90 can already be opened before the plug element 94 closes the outlet opening 92. In this case, in the first instance compressed air flows through the outlet opening 92, as a result of which the valve 52*b* is subjected to insufficient pressure in order to be switched into the release configuration.

It is only when the outlet opening 92 has been closed tightly by the plug element 94 that the valve 52*b* is subjected to the action of compressed air, via the pressure line 84*b*, to a sufficient extent for it to assume its release configuration. The fluid-pressure switch 56.4 is then present in its switching configuration. The corresponding application configuration of the changeover apparatus 10 is shown in FIG. 5A.

When the coupling unit 36 is disengaged from the supply unit 12.2 again for a color changeover, it is also the case that the outlet opening 92 is released again, and therefore compressed air flows out of the fluid line 84 via the outlet opening 92. The fluid-pressure switch 56.4 is then located in its blocking configuration.

The pressure at the valve 52*b* drops and the latter resumes its closed configuration, the flow channel 22 therefore being in the closed state. FIG. 5B shows a corresponding changeover configuration of the changeover apparatus 10.

Before the coupling unit 36 is disengaged from a supply unit 12, it is also possible, in the first instance, for the associated control valve 86 to be closed, in which case the pressure in the fluid line 84 and at the valve 52*b* drops, said valve then assuming its closed configuration.

It is possible in principle, in the case of the valve device 50*b*, for the control valves 86 to be dispensed with and for the fluid lines 84 to be subjected to the action of compressed air on a permanent basis from the compressed-air source 88. In this case, compressed air flows continuously out of each outlet opening 92 until one of the outlet openings 92 is closed by the coupling unit 36.

It is also the case with the pneumatic valves 52*b* that the conditions can be reversed in relation to those which have been explained above. The pneumatic valves 52*b* may also be configured such that they assume their closed position when they are subjected to the action of compressed air, and that they assume their release position when there is no pressure present. In this case, the control signal is predetermined by the absence of a control parameter, i.e. by the absence of any pressure present, at the respective valve 52*b*.

This can be realized, for example, in that the outlet opening 92 is closed by a nonreturn valve when the coupling unit 36 has been separated from the associated supply unit 12. The valve 52*b* is thus subjected to pressure and assumes its closed configuration. For this purpose, the nonreturn valve has a movable closing body which, in a basic configuration, closes the outlet opening 92 and, in an operating configuration, releases the outlet opening 92.

Instead of the closure device 58.4, it is then possible once again to use a pressure-exerting device 58.2 as the triggering device 58. The pressure-exerting element 80 thereof is designed, if appropriate, in the form of a narrow spike, which pushes back a movable closing body of the nonreturn valve when the coupling unit 36 is coupled to the supply unit 12. As a result, the outlet opening 92 is opened, compressed air can flow out of the line 84, the pressure at the valve 52*b* drops and said valve then assumes its release position.

The above described switching devices 56 and triggering devices of the electric and pneumatic valve devices 50*a*, 50*b* also form together in each case a safety device, which bears the reference sign 96 for all the exemplary embodiments. The triggering device 58, which is carried along by the coupling unit 36, and the respective switching device 56 always ensure that it is only the flow channel 22 from which the coupling unit 36 is intended to remove material which is actually released.

This is demonstrated particularly clearly by the example of the pneumatic valve device 50*b*. It may thus be the case that the distributor 90 is subject to a control error, which opens a control valve 86 which releases compressed air to a supply unit 12 other than the one intended. This is not sufficient, however, to release the flow channel 22 of the incorrectly activated supply unit 12, since the outlet opening 92 of said supply unit is not closed by the plug element 94 of the coupling unit 32. This means that any unintended discharge of material by way of a supply unit 12 is effectively prevented. This applies analogously to the electric valve device 50*a*.

The different control concepts explained above can also be combined with one another so that it is possible for various supply modules 12 to be provided with different switching devices 56 which, accordingly, interact with different triggering devices 58 on the coupling unit 36. Said triggering devices are then carried, accordingly, to different positions of the coupling unit 36, wherein the switching devices 56 are positioned, accordingly, in a complementary manner on the supply units 12.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

We claim:

1. A changeover apparatus for coating media comprising:

a) a plurality of supply units, each of which has at least one inlet connection, which is connectable to a reservoir for a medium, an outlet connection, and a flow channel extending between the at least one inlet connection and the outlet connection;

b) at least one coupling unit, which has an entry connection and an exit connection, which is connectable to an application device, and a through-channel extending between the entry connection and the exit connection;

c) a positioning device, by means of which the at least one coupling unit is movable relative to the plurality of supply units, wherein d) the entry connection of the at least one coupling unit is couplable in a fluid-tight manner to the outlet connection of a supply unit and is separable therefrom again;

e) a valve device is present, providing that each supply unit comprises a valve unit which, in a release configuration, releases the flow channel and, in a closed configuration, closes said channel and which is movable into the release configuration by means of a control signal, further wherein f) the valve device comprises a control system which fa) has a switching device for each supply unit, said switching device, in a switching configuration, allowing the control signal through to the valve unit and, in a blocking configuration, blocking the control signal to the valve unit;

fb) has a triggering device, which is carried along by the at least one coupling unit and which triggers at least one switching operation of the switching device from the blocking configuration into the switching configuration when the entry connection of the coupling unit is, or has been, coupled in a fluid-tight manner to the outlet connection of a supply unit from the plurality of supply units, wherein the valve device is an electric valve device and the valve unit of each supply unit is an electric valve which is arranged in a circuit which is closable or interruptible by the switching device and the electric valve assumes its release configuration when the circuit is closed and assumes its blocking configuration when the circuit is interrupted, the switching device is an electric bridge device with two contact locations which are accessible from the outside; and the triggering device is a bridging device by means of which the contact locations of the bridging device are connectible to one another.

2. A changeover apparatus for coating media comprising:

a) a plurality of supply units, each of which has at least one inlet connection, which is connectable to a reservoir for a medium, an outlet connection, and a flow channel extending between the at least one inlet connection and the outlet connection;

b) at least one coupling unit, which has an entry connection and an exit connection, which is connectable to an application device, and a through-channel extending between the entry connection and the exit connection;

c) a positioning device, by means of which the at least one coupling unit is movable relative to the plurality of supply units, wherein d) the entry connection of the at least one coupling unit is couplable in a fluid-tight manner to the outlet connection of a supply unit and is separable therefrom again;

e) a valve device is present, providing that each supply unit comprises a valve unit which, in a release configuration, releases the flow channel and, in a closed configuration, closes said channel and which is movable into the release configuration by means of a control signal, further wherein f) the valve device comprises a control system which fa) has a switching device for each supply unit, said switching device, in a switching configuration, allowing the control signal through to the valve unit and, in a blocking configuration, blocking the control signal to the valve unit;

fb) has a triggering device, which is carried along by the at least one coupling unit and which triggers at least one switching operation of the switching device from the blocking configuration into the switching configuration when the entry connection of the coupling unit is, or has been, coupled in a fluid-tight manner to the outlet connection of a supply unit from the plurality of supply units, wherein the valve device is an electric valve device and a valve unit of a supply unit is an electric valve which is arranged in a circuit which is closable or interruptible by the switching device and the electric valve assumes its release configuration when the circuit is closed and assumes its blocking configuration when the circuit is interrupted, the switching device is a spring-loaded switch with two contact locations and a spring-loaded, electrically conductive connecting piece, which is movable between a position in which it connects the two contact locations in a conductive manner and a position in which the circuit is interrupted; and the triggering device is a pressure-exerting device by means of which the connecting piece is pushable from one position into the other position.

3. A changeover apparatus for coating media comprising:

a) a plurality of supply units, each of which has at least one inlet connection, which is connectable to a reservoir for a medium, an outlet connection, and a flow channel extending between the at least one inlet connection and the outlet connection;

b) at least one coupling unit, which has an entry connection and an exit connection, which is connectable to an application device, and a through-channel extending between the entry connection and the exit connection;

c) a positioning device, by means of which the at least one coupling unit is movable relative to the plurality of supply units, wherein d) the entry connection of the at least one coupling unit is couplable in a fluid-tight manner to the outlet connection of a supply unit and is separable therefrom again;

e) a valve device is present, providing that each supply unit comprises a valve unit which, in a release configuration, releases the flow channel and, in a closed configuration, closes said channel and which is movable into the release configuration by means of a control signal, further wherein f) the valve device comprises a control system which fa) has a switching device for each supply unit, said switching device, in a switching configuration, allowing the control signal through to the valve unit and, in a blocking configuration, blocking the control signal to the valve unit;

fb) has a triggering device, which is carried along by the at least one coupling unit and which triggers at least one switching operation of the switching device from the blocking configuration into the switching configuration when the entry connection of the coupling unit is, or has been, coupled in a fluid-tight manner to the outlet connection of a supply unit from the plurality of supply units, wherein the valve device is an electric valve device and a valve unit of a supply unit is an electric valve which is arranged in a circuit which is closable or interruptible by the switching device and the electric valve assumes its blocking configuration when the circuit is closed and assumes its release configuration when the circuit is interrupted, the switching device is a spring-loaded switch with two contact locations and a spring-loaded, electrically conductive connecting piece, which is movable between a position in which it connects the contact locations in a conductive manner and a position in which the circuit is interrupted; and the triggering device is a pressure-exerting device by means of which the connecting piece is pushable from one position into the other position.

4. A changeover apparatus for coating media comprising:

a) a plurality of supply units, each of which has at least one inlet connection, which is connectable to a reservoir for a medium, an outlet connection, and a flow channel extending between the at least one inlet connection and the outlet connection;

b) at least one coupling unit, which has an entry connection and an exit connection, which is connectable to an application device, and a through-channel extending between the entry connection and the exit connection;

c) a positioning device, by means of which the at least one coupling unit is movable relative to the plurality of supply units, wherein d) the entry connection of the at least one coupling unit is couplable in a fluid-tight manner to the outlet connection of a supply unit and is seperable therefrom again;

e) a valve device is present, providing that each supply unit comprises a valve unit which, in a release configuration, releases the flow channel and, in a closed configuration, closes said channel and which is movable into the release configuration by means of a control signal, further wherein f) the valve device comprises a control system which fa) has a switching device for each supply unit, said switching device, in a switching configuration, allowing the control signal through to the valve unit and, in a blocking configuration, blocking the control signal to the valve unit;

fb) has a triggering device, which is carried along by the at least one coupling unit and which triggers at least one switching operation of the switching device from the blocking configuration into the switching configuration when the entry connection of the coupling unit is, or has been, coupled in a fluid-tight manner to the outlet connection of a supply unit from the plurality of supply units, wherein the valve device is an electric valve device and a valve unit of a supply unit is an electric valve which is arranged in a circuit which is closable or interruptible by the switching device and the electric valve assumes its blocking configuration when the circuit is closed and assumes its release configuration when the circuit is interrupted, the switching device is a magnetic switch by means of which, in one configuration, the circuit is closable, or in one configuration, the circuit is interruptible; and the triggering device is a magnetic actuator by means of which the magnetic switch is switchable from one configuration into the other configuration.

* * * * *